United States Patent [19]

Zhiklenkov et al.

[11] 4,003,231

[45] Jan. 18, 1977

[54] ROTARY MACHINE FOR MANUFACTURING HOLLOW ARTICLES

[76] Inventors: Viktor Konstantinovich Zhiklenkov, ulitsa 25 Sentyabrya, 54, kv. 26; Viktor Mikhailovich Ilin, ulitsa Rumyantseva, 15, kv. 14, both of Smolensk; Vitaly Matveevich Tanygin, ulitsa Teatralnaya, 3, kv. 66, Klimovsk Moskovskoi oblasti; July Fedorovich Martynenkov, ulitsa Oktyabrskoi revoljutsii, 7, kv. 92, Smolensk, all of U.S.S.R.

[22] Filed: Aug. 18, 1975

[21] Appl. No.: 605,675

[52] U.S. Cl. ..... 72/59

[51] Int. Cl.[2] ..... B21D 15/10

[58] Field of Search ..... 72/59, 58, 54

[56] References Cited

UNITED STATES PATENTS

| | | | |
|---|---|---|---|
| 701,549 | 6/1902 | Deering | 72/58 |
| 1,271,455 | 7/1918 | Fitts | 72/59 |
| 2,610,667 | 9/1952 | Puster | 72/59 X |
| 2,796,109 | 6/1957 | Wood | 72/59 |
| 3,512,385 | 5/1970 | Adolphi | 72/59 |

*Primary Examiner*—Leon Gilden
*Attorney, Agent, or Firm*—Lackenbach, Lilling & Siegel

[57] ABSTRACT

The rotary machine, particularly for manufacturing bellows-type articles, includes a shaping device with a rotor. The shaft of the rotor has mounted thereon a drum carrying slides, each slide being adapted to accommodate a hollow blank, to advance it into the axial bore of the respective female die and to fill the internal space of the blank with a liquid medium under pressure. The auxiliary drum likewise mounted on the rotor shaft carries male dies. A holder structure for the female dies, arranged coaxially with the male dies, is mounted on the rotor shaft intermediate the two drums. Each female die includes a plurality of closed-end sleeves received coaxially one within another, each sleeve having a bore in the bottom thereof to accommodate a blank therein and having grooves on the external surface of this bottom to form corrugations in the article being manufactured. The sleeves are spaced axially from one another and are movable toward one another, as the female die is driven toward the male die to shape the article. Each sleeve is made up of two parts, the plane dividing these two parts being along the axis of the female die. The two parts of the sleeve are movable radially to provide for loading a blank thereinto and for removing a shaped article therefrom. The disclosed machine is operable for automatic production of bellows of relatively high quality, and that at a high rate.

6 Claims, 10 Drawing Figures

ROTARY MACHINE FOR MANUFACTURING HOLLOW ARTICLES

The present invention relates to pressure-working of materials and, more particularly, it relates to rotary machines for manufacturing hollow article with application of pressure.

The present invention can be employed to utmost advantage for manufacturing corrugated thin-wall hollow articles, particularly those of the bellows type.

There are known rotary machines for making hollow articles, usually from sheet blanks.

Such known rotary machines include a device for shaping the articles, as well as machanisms for loading blanks and for removing shaped articles, the mechanisms including conveying rotors drivingly interconnected with each other and with the article shaping device through gear trains.

The article shaping device is a rotor having a shaft carrying thereon a drum supporting a plurality of male dies arranged parallel with the axis of the rotor shaft.

The rotor shaft further carries a holder structure with female dies arranged coaxially with the respective male dies. The article shaping device includes means for reciprocation of the male dies, during which the latter are repeatedly driven toward the female dies.

In the known apparatus a female die is a tapering sleeve in the internal space of which the respective male die deforms a sheet blank to shep it into a hollow article (see, for example, "Automatic Rotary Lines in Stamping Production" by Koshkin and Preis, MASHGIZ Publishers, Moscow, 1962, page 7, FIG. 2).

However, the known apparatus with a female die of the above-specified structure cannot be operated for production of corrugated articles.

Following the high level of development of systems for controlling and regulating various productions, vehicles, industrial and domestic appliances, there has been recently created a great demand for hollow corrugated articles, e.g. those of the bellows type.

For instance, bellows are widely employed in aircraft and motor vehicles: thus, a bellows is the major part in the thermostats incorporated in automobile and aircraft engines.

At present, there are employed for production of corrugated articles, e.g. of bellows, machines including a pair of coaxially arranged fluid cylinders, receiving therebetween a female die made up by a plurality of sections, a chuck head with a closed bottom for sealingly clamping a tubular blank, mounted on the piston rod of one of the fluid cylinders, and a male die adapted to drive the sections of the female die toward one another along guide rods.

Each section of the female die in the known machine includes two plates lying in the same plane and interconnected at one side thereof with a pivot, the plates being lockable at the opposite sides with a snap-on lock.

The bottom plate has made therein openings for the guide rods, along which the sections of the female die are driven toward one another during a corrugation-shaping operation.

Each section of the female die has at the center thereof a groove with an opening adapted to accommodate a tubular blank.

However, when the sections of a female die are driven toward one another in the known machine, the plates of any one of the sections might be displaced relative to each other on account of the insufficient rigidity of their connection. As a result, the bellows more often than not have skewed corrugations and external diameters which deviate from the rated values.

When bellows are produced in the abovespecified known machines, the problem of maintaining their quality at a stable high level is a complicated one, its solution depending to a great degree on the personal skill of the operator. Besides, the rate of the deformation of a blank at shaping of the corrugations would not be kept permanent, which has been also found to affect the quality of the bellows produced.

Manufacturing of bellows in the known machines involves a number of manually performed operations, which curbs the productivity of the process.

In case of large-series and mass production of bellows a relatively great number of the known machines have to be operated, which occupies a considerable amount of floor space.

It is, therefore, the main object of the present invention to create a rotary machine for manufacturing hollow articles, wherein the shaping device should be of a structure ensuring production of articles with a stable and high quality, and that with a high productivity.

This and other objects are attained in a rotary machine for manufacturing hollow articles, wherein the device for shaping the articles is drivingly connected with a blank loading device and with a shaped article removing device and comprises a rotor assembly carrying a plurality of male dies arranged parallel with the axis of the shaft of the rotor, a holder structure with a plurality of female dies, arranged coaxially with the said male dies, mounted on said shaft, and means for advancing the male and female dies toward each other, in which machine, according to the present invention, each female die includes a plurality of closed-end sleeves coaxially receivable one within an other, the sleeves having axial bores in their bottoms to accommodate a hollow blank therein and grooves in the external surfaces of these bottoms adapted to shape corrugations in the blank, the sleeves being axially spaced and being movable toward one another, as the male die is driven toward the female die, each sleeve being made up of two parts with the plane of their division being along the axis of the female die, the parts being movable relative to this axis radially, so that a blank can be loaded thereinto and a shaped article can be removed therefrom, the rotor shaft having mounted thereon to the side of the female dies, remote from the male dies, a drum carrying slides arranged coaxially with the female dies and each having a mandrel for receiving thereon a hollow blank, each slide being adapted to feed the blank into the bore of the female die and to establish communication of the internal space of the blank with a source of a liquid medium under pressure, the liquid medium effecting pre-corrugation of the blank.

Thus, a rotary machine for manufacturing hollow articles, constructed in accordance with the present invention, provides for manufacturing corrugated hollow articles, e.g. those of the bellows type, as well as for automation of the production process and, therefore, for cutting down substantially the time required for the production of a single article, for reducing the amount of the labour consumed and thus for cutting down the production costs.

It is expedient that the radial displacement of the parts of the sleeves of each female die should be effected by a slide mounted on the drum and arranged parallel with the male die, the slide being connected through a linkage with the external sleeve of the female die.

Such a driving connection ensures reliable securing of the parts of the sleeves of each female die and their radial spreading, which provides for automatic loading of blanks and removing of shaped articles.

It is also expedient that each male die should be connected with the internal sleeve of the respective female die with the help of a stud extending transversely of the longitudinal axis of the female die, all the sleeves of the latter being coupled in the axial direction for their successive spreading in this direction.

The above feature provides for automatic spreading of the sleeves of the female die through distances corresponding to the spacing or pitch of the corrugations of the article to be shaped.

It is further expedient that each slide should have a through axial bore receiving therein the mandrel likewise having an axial bore therethrough, the mandrel supporting a spring-urged bushing adapted to urge a blank to the male die, as well as means for sealing away the junction between the bore of the mandrel and the internal space of the blank.

The above feature enables the feeding of a liquid medium under pressure into the internal space of the blank to effect its pre-corrugation.

It is likewise expedient that the sealing means should include two bushings received one within the other, the internal one of the bushings being in the form of a collet imbracing the mandrel and the external one being connected through a pivoted arm with a slide mounted in the drum, parallel with the slide carrying the mandrel.

The above structural feature provides for dependable sealing of the internal space of the blank, when it is being filled with the liquid medium under pressure, which is an important prerequisite of a corrugating operation of an adequate quality.

It is still further advisable that the mandrel of each slide should have a tapering end portion adapted to receive thereon a blank.

This feature facilitates positioning of a blank.

The herein disclosed rotary machine for manufacturing hollow corrugated articles, e.g. bellows, provides for automatic production of bellows of adequately high quality. Besides, a rotary machine in accordance with the invention substantially increases the productivity of labour. Bellows produced in such a machine have been found to be of a high quality, the amount of defective articles being infinitesimal.

Other features and advantages of the present invention will be made more apparent in the following description of an embodiment thereof, with reference being had to the accompanying drawings, wherein.

Figure 9:
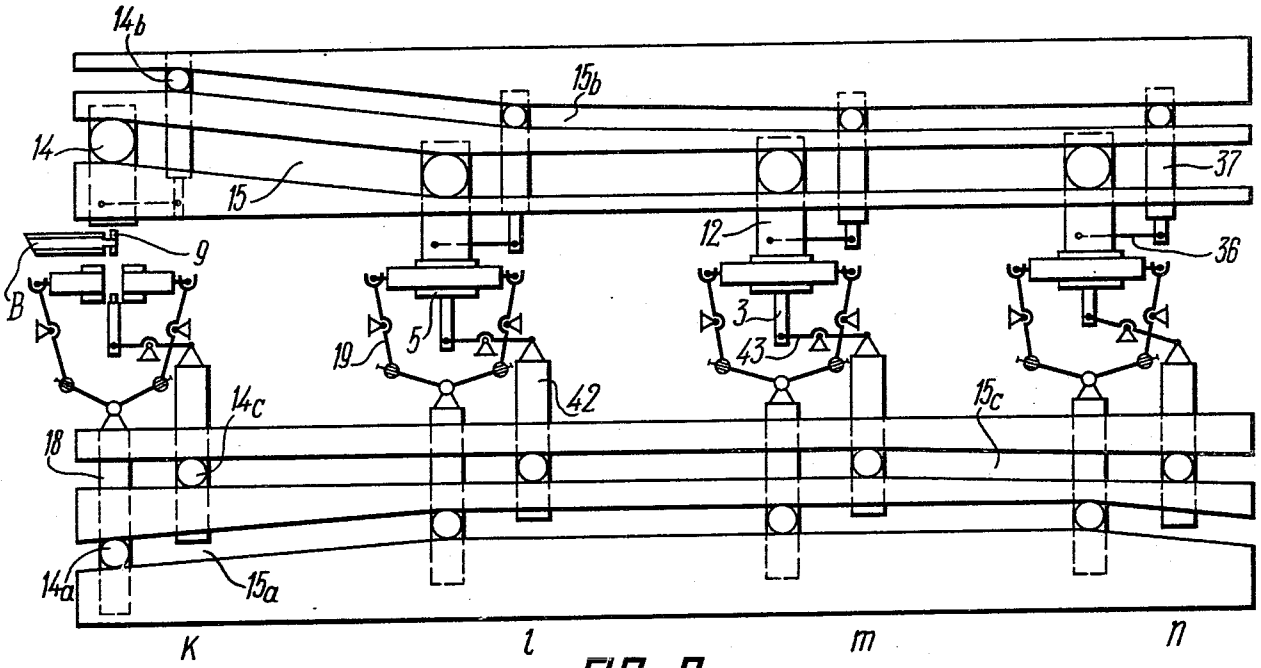
Figure 10:
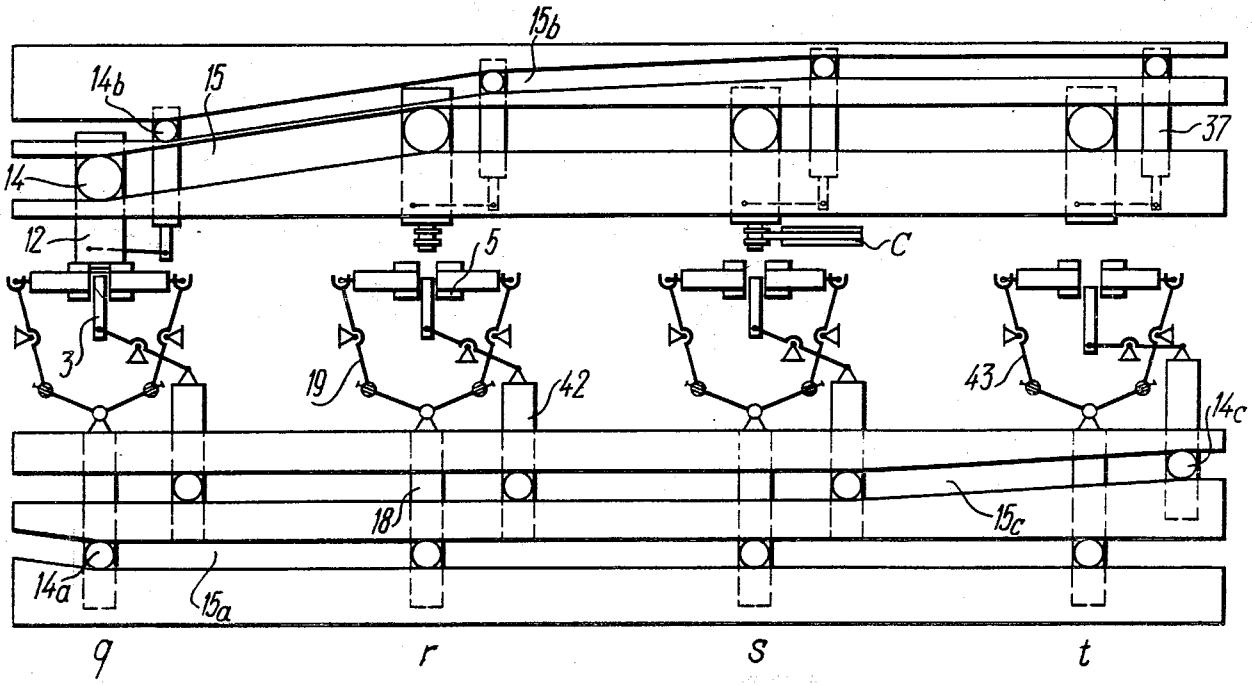

FIG. 9 and FIG. 10 present the operating cycle diagram of the disclosed rotary machine.

Figure 2:
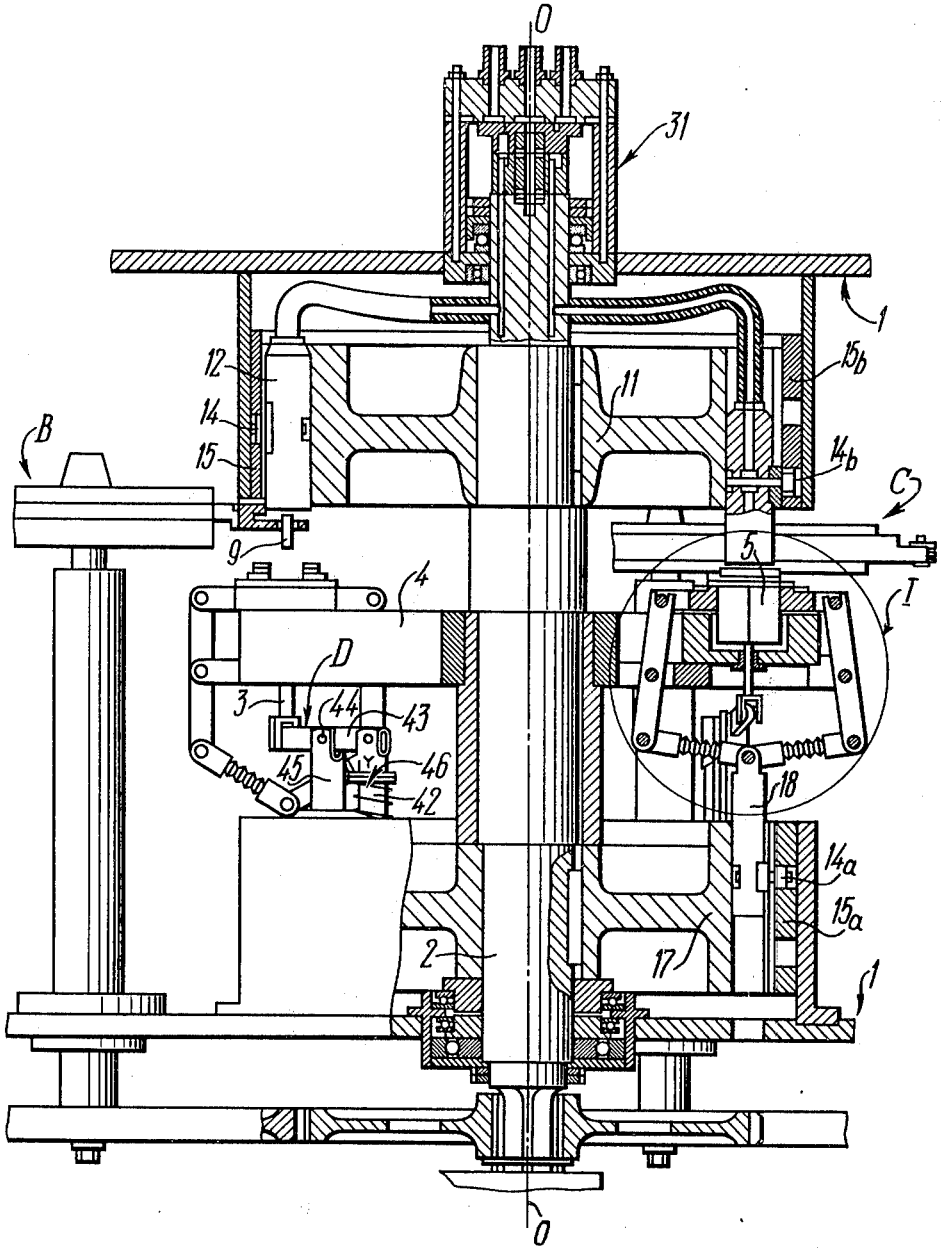
FIG. 2 is a longitudinally sectional view of the article shaping device.
Figure 3:
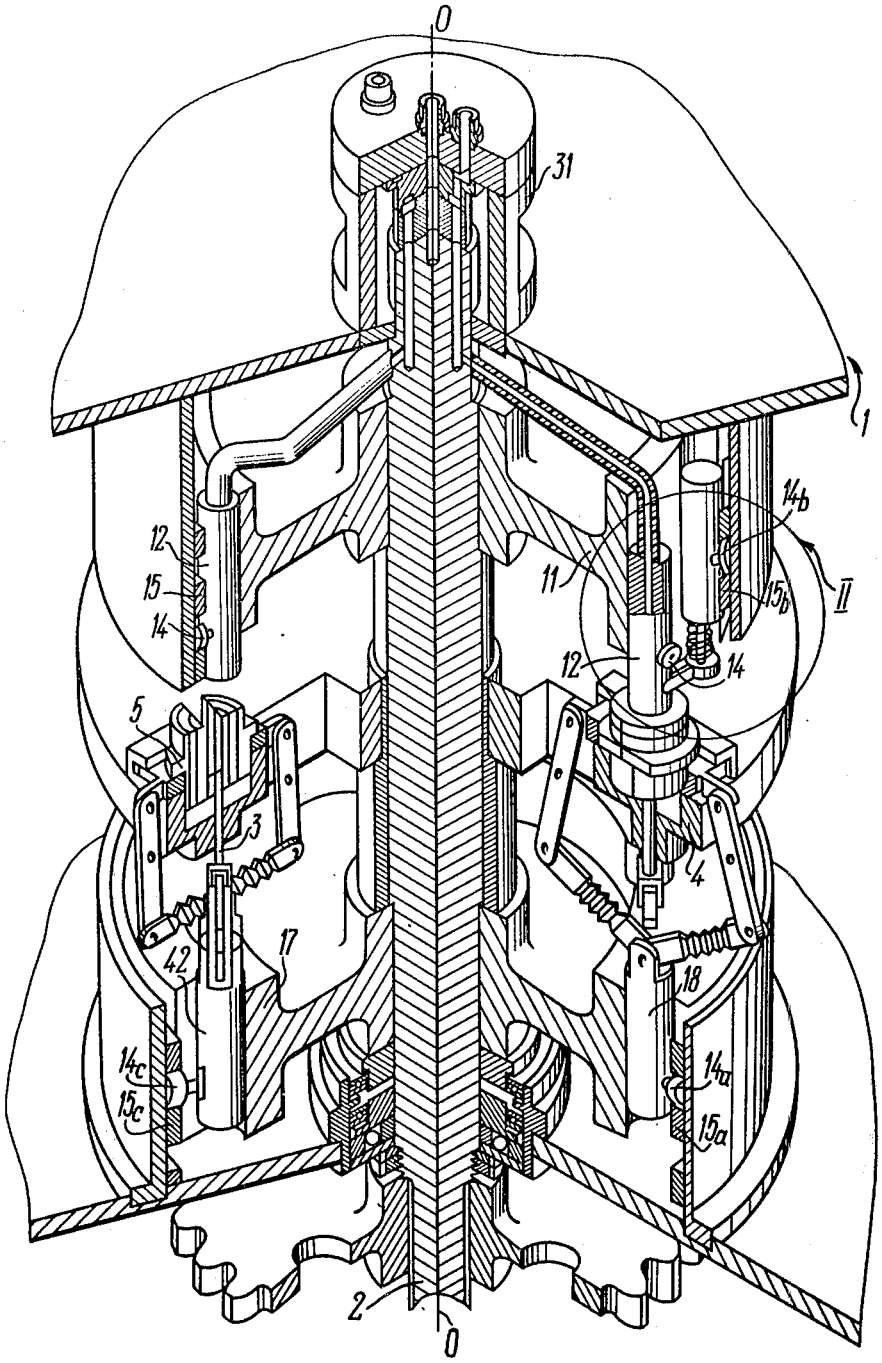
FIG. 3 is a perspective partial sectional view, partial cut away view of the article shaping device in accordance with the invention.

The herein disclosed rotary machine for manufacturing hollow articles comprises a device A (FIG. 1) for shaping articles, drivingly connected with a device B for loading the blanks and with a device C for removing the shaped articles. The device A includes a framework 1 (FIGS. 2 and 3) supporting a rotor assembly with a shaft 2 having its ends journalled for rotation in the framework 1. The rotor assembly further includes male dies 3 (FIG. 3) arranged parallel with the axis O—O of the shaft 2. The shaft 2 supports a holder structure 4 having mounted therein female dies 5 coaxial with the respective male dies. The rotor assembly further includes a device D (FIG. 2) for driving the male dies 3 toward the female dies 5 in operation of the machine.

Figure 1:
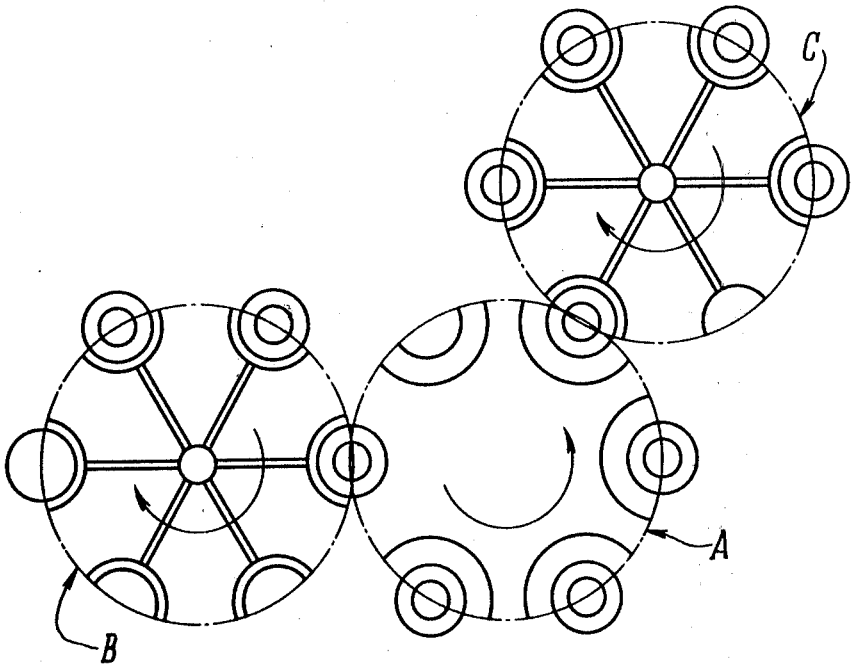
FIG. 1 is a schematical plan view of a rotary machine embodying the invention.
Figure 4:
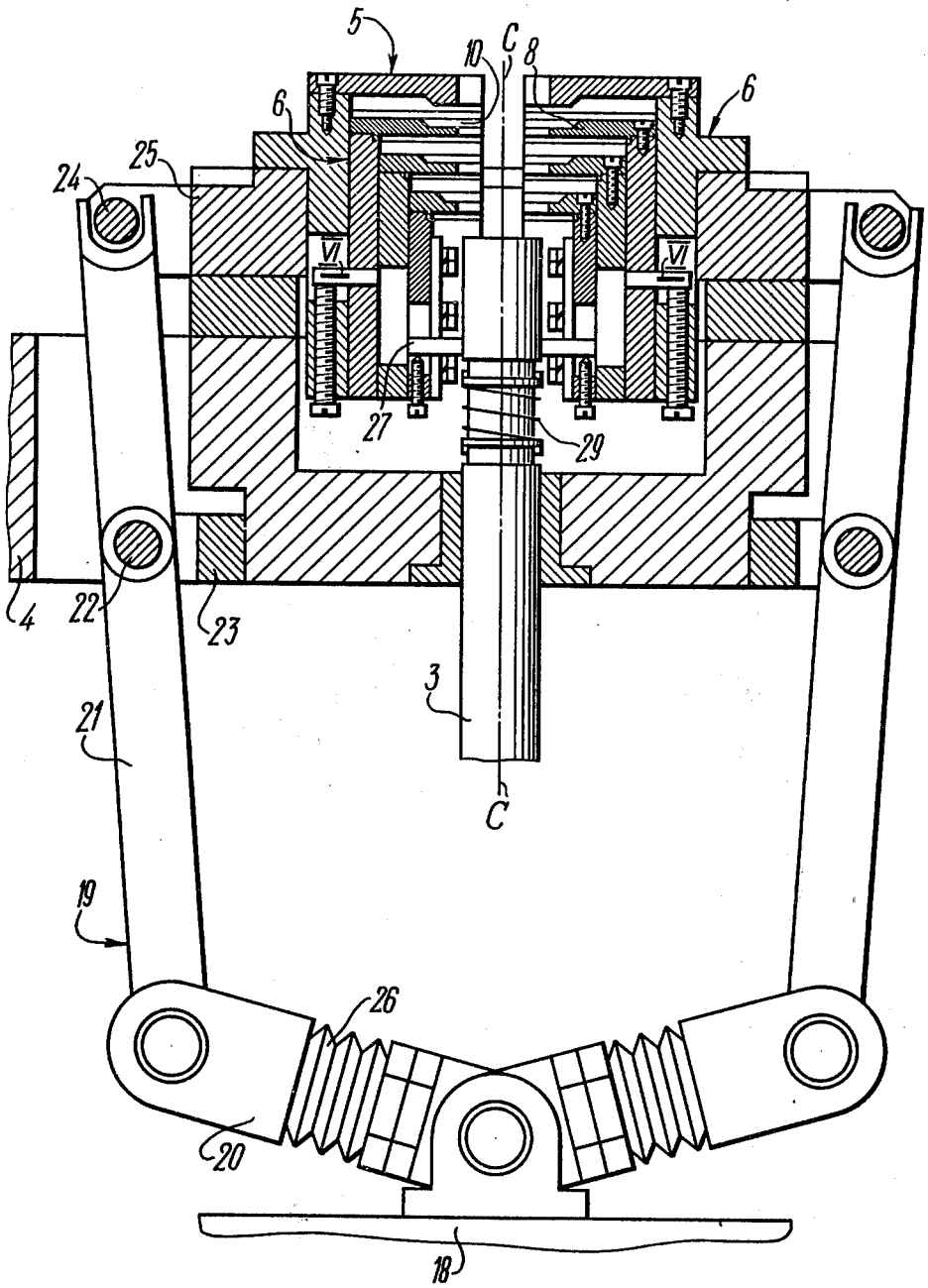
FIG. 4 shows on a larger scale the area I in FIG. 2.
Figure 5:
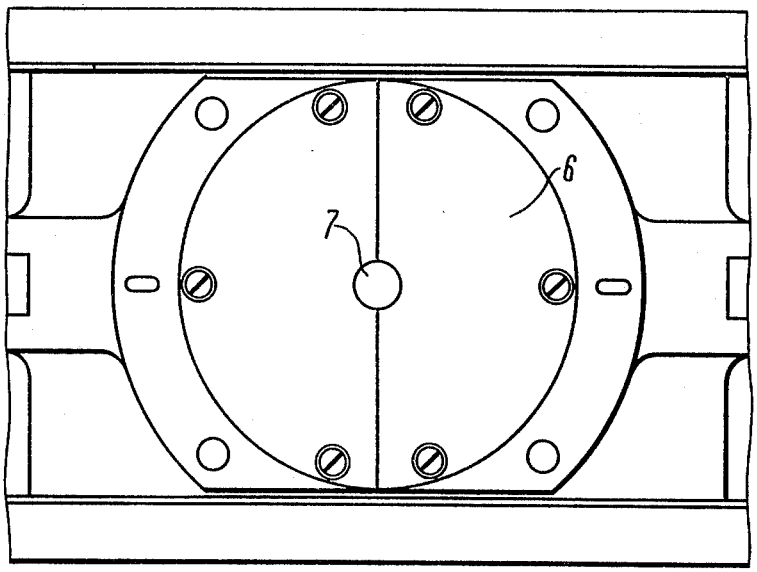
FIG. 5 is a top plan view of the device shown in FIG. 4.
Figure 6:
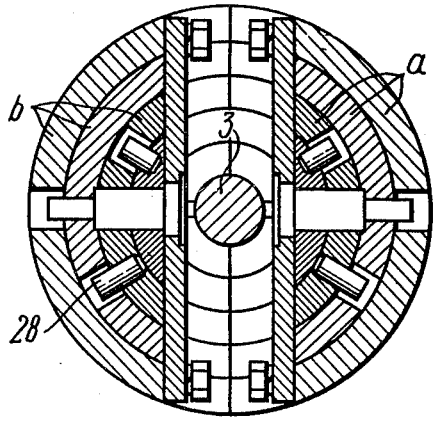
FIG. 6 is a sectional view taken on line VI — VI of FIG. 4.
Figure 7:
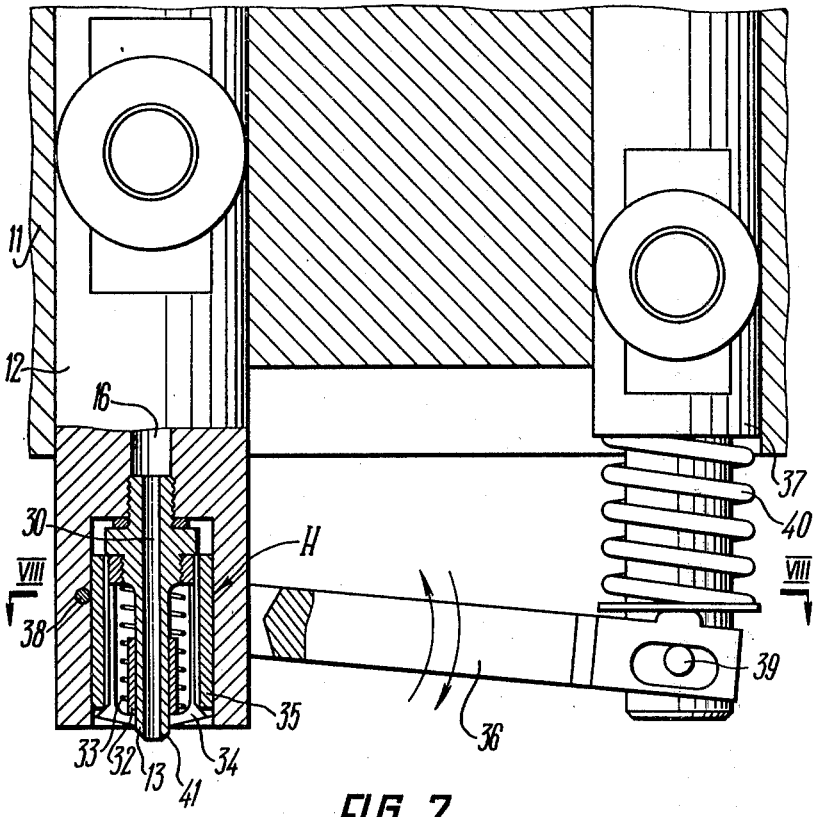
FIG. 7 shows on a larger scale the area II in FIG. 3.

Each female die 5 (FIG. 4) includes a plurality of sleeves 6 arranged coaxially and received one withon another, each sleeve having an axial bore 7 (FIG. 5) in its bottom 8 (FIG. 4), adapted to accommodate therein a hollow blank 9 (FIG. 2), and grooves 10 (FIG. 4) made in the external surfaces of these bottoms 8 for shaping corrugations in the blank 9. The sleeves 6 (FIG. 4) are somewhat spaced in the axial direction, so that they can be driven toward one another, as the respective male die 3 moves toward the female die 5. Each sleeve 6 is made up of two parts *a* and *b* (FIG. 6), the plane of the division of these two parts being along the axis C—C (FIG. 4) of the female die 5. The shaft 2 (FIGS. 2 and 3) of the rotor assembly carries a drum 11 to the side of the female dies 5, remote from the male dies 3, the drum 11 carrying a plurality of slides 12 (FIG. 7) arranged coaxially with the respective female dies 5, each slide supporting a mandrel 13 adapted to receive thereon a hollow blank 9 (FIG. 2) fed by the loading device B (FIG. 1). Each slide 12 is adapted to advance the blank 9 into the bore 7 (FIG. 5) of the female die 5, for which purpose the slide 12 (FIGS. 2 and 3) carries a follower 14 of which the axis of rotation is perpendicular to the longitudinal axis of the slide 12. The follower 14 is accommodated in a cam groove of a stationary internal cam 15 secured on the freamework 1. Furthermore, each slide 12 has made therein an axial passage 16 (FIG. 7) via which a liquid medium under pressure is supplied in operation into the internal space of the blank 9.

The shaft 2 (FIG. 2 and FIG. 3) of the rotor assembly further carries an auxiliary drum 17 having mounted therein auxiliary slides 18 parallel with the respective male dies 3. Each auxiliary slide 18 is connected with the external sleeve 6 of the respective female die 5 via a linkage 19 (FIG. 4) including two links 20, each link being pivotally connected with the respective auxiliary slide 18 and with a rocker arm 21 rockable about a pivot pin 22 mounted on the bracket 23 of the holder 4 of the female die 5. The rocker arm 21 is connected with the external sleeve 6 of the female die 5 by means of a pivot pin 24 mounted on a carriage 25 fast with the external sleeve 6. Each auxiliary slide 18 carries a follower 14*a* (FIGS. 2 and 3) of which the axis of rotation is perpendicular to the longitudinal axis of the slide 18. The follower 14*a* is accommodated in a cam groove of a stationary internal cam 15*a* secured on the framework 1.

The above structure provides for the required displacement of the parts *a* and *b* of the sleeves 6 of each female die 5 in the radial direction.

Each link 20 includes a compensator structure 26 (FIG. 4) in the form of a stack of disc springs, adapted to compensate in operation for small discrepancies in the dimensions of the parts of the female die assembly, of the linkage and of the slide, which might be caused by slight manufacturing and assembling errors.

Each male die 3 is connected with the internal sleeve 6 of the respective female die 5 by means of a stud 27 extending perpendicularly to the longitudinal axis C—C of the female die 5, the stud 7 having its central portion press-fit in the body of the male die 3 and having its opposite ends bearing upon set screws received in the parts *a* and *b* of the internal sleeve 6. The sleeves 6 are interconnected in the direction of the longitudinal axis C—C of the female die 5 with the aid of studs 28 (FIG. 6) extending transversely of this axis, so that the sleeves 6 should be successively axially spread apart in operation. Each stud 28 has one of its end press-fit in one of the sleeves 6, its other end being freely received in a port provided in the wall of the adjacent sleeve and bearing upon a set screw threaded into the last-mentioned sleeve, the screw being parallel with the longitudinal axis of the female die.

The abovedescribed connection of the sleeves 6 of each female die assembly 5 with each other and of the sleeves 6 with the male die 3 provides for successive axial spreading of the sleeves 6 and their accurate positioning, so that the bottoms 8 of the set of the sleeves 6 with the grooves 10 cut in their external surfaces are axially spaced by distances calculated to correspond to the spacing or pitch of the corrugations of a bellows to be manufactured.

The male die 3 incorporates a compensator 29 (FIG. 4) in the form of a coiled spring, to compensate for small discrepancies in the dimensions of the parts of the male die assembly that might be caused by slight manufacturing and assembling errors.

It has been already mentioned that each slide 12 (FIG. 7) mounted in the drum 11 has an axial passage 16 receiving the mandrel 13, the latter likewise having an axial passage 30 made therethrough. These axial passages are provided to supply a liquid medium under pressure into the internal space of the blank 9 (FIG. 2) from a liquid distributor assembly 31 (FIGS. 2 and 3) in the course of a shaping operation. The mandrel 13 receives thereabout a bushing 32 (FIG. 7) adapted to press the blank 9 (FIG. 2) to the male die 3 with the effort of a spring 33 (FIG. 7) received about the bushing 32.

The axial passage 16 of each slide 12 has mounted therein a device H (FIG. 7) for sealing in operation the junction between the passage 30 of the mandrel 13 and the internal space of the blank 9. The sealing device H includes an internal bushing 34 and an external one 35 received one within the other. The internal bushing 34 is in the form of a collet enveloping the mandrel 13.

The provision of the sealing device H enables maintenance of the pressure of the liquid medium internally of the blank.

Figure 8:
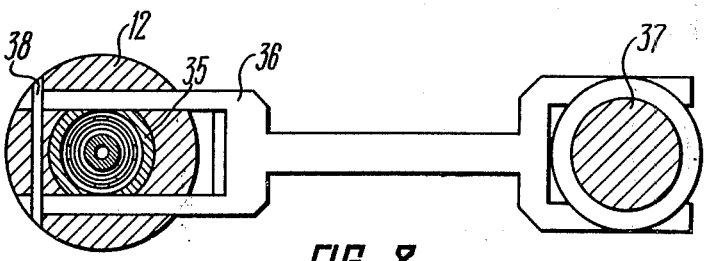
FIG. 8 is a sectional view taken on line VIII—VIII of FIG. 7.

The external bushing 35 is connected via a pivoted arm 36 (FIGS. 7 and 8) with a slide 37 adapted to actuate the sealing device H in operation. The slide 37 is mounted in the drum 11 and extends parallel with the slide 12. The arm 36 has one end thereon received in slots cut in the bushing 35, its opposite end being connected with the slide 37 by means of a pin 39 (FIG. 7) press-fit in the slide. Each slide 37 has mounted therein a follower 14*b* (FIG. 3) having its axis of rotation extending perpendicularly to the longitudinal axis of the slide. The follower 14*b* is received in the cam groove of a stationary internal cam 15*b* fast with the framework 1.

Each slide 37 (FIG. 7) incorporates a compensator 40 in the form of a coiled spring having one of its end bearing through a washer upon the lug of the arm 36 and its other end bearing upon the slide 37. The compensator 40 is adapted to compensate for slight deiscrepancies in the dimensions of the parts of the slide 37 and of the sealing device H that might be caused by slight manufacturing and assembling errors.

The slide 37 effects successively, first, liquid-tight urging of the blank 9 with the bushing 34 and then releasing of the shaped bellows.

The mandrel 13 of each slide 12 has a tapered end 41 onto which a blank 9 is put by the loading device B (FIG. 1).

The means D (FIG. 2) for driving the male dies 3 toward the female dies 5 includes a plurality of slides 42, each slide 42 being pivotally connected with one end of a rocker arm 43 rockable about a pivot pin 44 mounted in a post 45. The opposite end of the rocker arm 43 is pivotally connected with the respective male die 3.

Each slide 42 carries a follower 14*c* (FIG. 3) having its axis of rotation extending perpendicularly to the longitudinal axis of the slide 42, the follower 14*c* being received in the cam groove of a stationary internal cam 15*c* fast with the framework 1.

Each slide 42 (FIG. 2) incorporates a compensator 46 in the form of a coild compression spring adapted to compensate for discrepancies in the dimensions of the parts of the means D that might be caused by slight manufacturing and assembling errors.

Bellows are shaped in the rotary machine constructed in accordance with the present invention and embodied, as it has been described hereinabove, in the following way.

The loading device B feeds a tubular blank 9 into the article shaping device A of which the major part is the rotor assembly. The blank 9 is placed intermediate the slide 12 and the female die assembly 5. The members of the rotary machine are in the positions corresponding to the phase *k* of the operating cycle (FIG. 9).

As the rotor assembly rotates in operation, each slide is reciprocated relative to the female die assembly, the reciprocation being controlled by the follower 14 of this slide 12, rolling in the respective cam groove of the internal cam 15. The tubular blank 9 is put about the tapering end 41 of the mandrel 13, to abut against the bushing 32.

As the rotor assembly rotates further on, the slide 12 is driven toward the female die 5, and the blank 9 abuts against the male die 3.

Now the parts *a* and *b* of all the sleeves 6 of the respective female die assembly 5 are radially driven toward each other, this motion of the parts *a* and *b* of the sleeves 6 being effected by the auxiliary slide 18 through the linkage 19. The members of the rotary machine assume the position corresponding to the phase 1 of the operating cycle.

The following rotation of the rotary assembly results in the slide 37 moving so that it rotates the arm 36 about the pivot pin 38, whereby the bushing 35 is displaced and engages the tapering part of the bushing 34, the blank 9 being thus tightly seated on the mandrel 13.

The members of the rotary machine assume the positions corresponding to the phase *m* of the operating cycle. The liquid medium from a corresponding source is fed under pressure through the distributor 31 into the axial passage 16 of the slide 12, into the axial passage 30 of the mandrel 13 and, finally, into the internal space of the blank 9, expanding the latter.

As the rotor assembly rotates still further, the slide 42 of the means D for driving the male die 3 toward the female die assembly 5 operates the rocker arm 43 to actuate the male die 3 which latter displaces the sleeves 6 of the female die 5 toward one another in the direction of the longitudinal axis C—C of the female die 5. The bottoms 8 of the sleeves 6 are driven toward one another until they abut, whereby corrugations are shaped in the blank 9.

Now the members of the rotary machine assume the positions corresponding to the phase *n* of the operating cycle.

Then the axial passages 16 and 30, respectively, of the slide 12 and mandrel 13 are connected to a drain line (not shown), and the pressure of the liquid medium is released.

With the rotor assembly rotating still further, the auxiliary slide 18 is displaced and operates the linkage 19 to spread radially the parts *a* and *b* of the sleeves 6 of the female die assembly 5.

The members of the rotary machine assume the positions corresponding to the phase *q* of the operating cycle (FIG. 10).

The slides 12 and 37 are simultaneously driven away from the female die 5, removing the shaped bellows therefrom (the positions corresponding to the phase *r*).

The members of the delivery device C grip the bellows, while the slide 37 is displaced to pivot the arm 36, whereby the bushing 35 is also displaced and releases the bushing 34, so that the latter releases the bellows. The delivery device C transfers the bellows to a successive working station of the production line.

The members of the rotary machine assume the position corresponding to the phase *s*.

Further rotation of the rotor assembly results in the slide 42 driving the male die 3 away from the female die 5, and the sleeves 6 are positioned so that their respective bottoms are spaced by distances corresponding to the required spacing or pitch of the corrugations of the bellows to be shaped.

The members of the rotary machine now assume the initial positions corresponding to the phase *t* and are prepared to repeat the operating cycle.

A test prototype of the herein disclosed rotary machine has been production-tested, and the outcome of the tests has shown the high productivity of the machine. The machine has been found capable of shaping up to 100 bellows 23 mm in diameter, with four corrugations in 1 minute. The rotary machine occupies a moderate amount of the floor space and completely eliminates manual labor.

The bellows shaped by the prototype of the herein disclosed machine are of a high quality, the amount of defective bellows being but a very small fraction of the total number of the bellows shaped by the machine.

We claim:

1. A rotary machine for manufacturing hollow articles, comprising; a framework; a device for loading blanks, mounted on said framework; a device for delivering shaped articles, also mounted on said framework; an article shaping device, mounted on said framework; said article shaping device, said blank loading device and said article delivering device being operatively connected with one another; said article shaping device incorporating a rotor assembly including: a shaft journalled in said framework; a support structure mounted on said shaft; a plurality of female die assemblies supported by said holder structure, each said female die assembly including a plurality of sleeves arranged coaxially and axially spaced from one another and adapted for being driven toward one another in an article shaping operation, each one of said sleeves being made up of two parts, the plane of the division of these parts being along the axis of said female die assembly, the said parts of each said sleeve being adapted to be radially reciprocated to clamp a blank in said female die assembly and to release a shaped article; grooves made in the external surfaces of the bottoms of said sleeves for shaping corrugations in a blank; an axial bore made axially in the bottom of each said sleeve and adapted to accommodate a blank therein; a drum mounted on said shaft of said rotor assembly to one side of said support structure of said female die assemblies; slides mounted in said drum coaxially with the respective ones of said female die assemblies, each said slide being adapted to feed a blank into the axial bores of the bottoms of said sleeves of said respective female die assembly and to effect filling of the internal space of a blank with a liquid medium under pressure, to initiate pre-shaping of the corrugations in the blank; a mandrel mounted in each said slide and adapted to receive a blank thereon; an auxiliary drum mounted on said shaft of said rotor assembly to the side of said support structure, remote from said first-mentioned drum; a plurality of male dies mounted in said auxiliary drum coaxially with the respective ones of said female die assemblies and extending parallel with the axis of said shaft; means for driving said male dies toward said female dies, mounted in said auxiliary drum; means for effecting radial reciprocation of the parts of said sleeves.

2. A rotary machine of claim 1, wherein said means for effecting radial reciprocation of the parts of said sleeves of each said female die assembly includes an auxiliary slide mounted in said auxiliary drum, extending parallel with said male die and connected via a linkage to the external one of said sleeves of said female die assembly.

3. A rotary machine of claim 1, wherein each said male die is connected with the internal one of said sleeves of the respective one of said female die assemblies via a stud extending transversely of the longitudinal axis of said female die assembly, all said sleeves of the latter being successively interconnected in the axial direction for being successively spread apart in this direction.

4. A rotary machine of claim 1, wherein each said slide has an axial passage therethrough receiving therein said mandrel, the latter likewise having an axial passage therethrough and carrying a spring-urged bushing for urging a blank to said male die, and a device for sealing the junction between the passage of said mandrel and the internal space of the blank.

5. A rotary machine of claim 4, wherein said device for sealing away the junction includes bushings received one within the other, the internal one of these bushings being in the form of a collet enveloping said mandrel, the external one of these bushings being connected through a pivotable arm with another slide mounted in said drum and extending parallel with said slide carrying said mandrel.

6. A rotary machine of claim 4, wherein said mandrel of each said mandrel-carrying slide has a tapered end portion adapted to receive a blank thereon.

* * * * *